United States Patent [19]

Oakley

[11] Patent Number: 4,490,129

[45] Date of Patent: Dec. 25, 1984

[54] FORMING CARTONS

[75] Inventor: John R. Oakley, Swindon, England

[73] Assignee: Metal Box P.L.C., Reading, Great Britain

[21] Appl. No.: 353,242

[22] Filed: Mar. 1, 1982

[30] Foreign Application Priority Data

Mar. 2, 1981 [GB] United Kingdom ..... 8106509

[51] Int. Cl.[3] ..... B31B 1/62; B31B 3/60

[52] U.S. Cl. ..... 493/8; 493/129; 493/134; 493/151; 493/174

[58] Field of Search ..... 493/129, 128, 134, 133, 493/135, 7, 265, 274, 174, 171, 10, 8, 332, 151

[56] References Cited

U.S. PATENT DOCUMENTS

| | | | |
|---|---|---|---|
| 2,984,598 | 5/1961 | Gobalet | 156/230 X |
| 3,056,337 | 10/1962 | Bahr et al. | 493/7 |
| 3,196,761 | 7/1965 | Ullman | 493/130 X |
| 3,218,940 | 11/1965 | Pearson | 493/130 |
| 3,511,138 | 5/1970 | Baker | 493/129 X |
| 3,648,573 | 3/1972 | LeFebvre et al. | 493/134 X |
| 4,261,254 | 4/1981 | Nowacki | 493/7 |

FOREIGN PATENT DOCUMENTS 0017678 10/1980 European Pat. Off. .

*Primary Examiner*—James F. Coan

*Attorney, Agent, or Firm*—Burns, Doane, Swecker & Mathis

[57] ABSTRACT

In the forming of cartons, a water-based adhesive, e.g. an aqueous-dispersed polyvinylacetate, is applied as an atomized spray by guns to selected parts of a carton blank of uncoated board and partially dried by hot gas (air) jets, and the carton is erected by forcing the carton blank by a punch through a forming die so that the selected parts are pressed briefly against cooperating parts of the carton to secure them together, by means of projections on the punch and pressure members forming part of the die. The atomized spraying followed by hot air drying of the adhesive enables adhesion to be effected by very brief pressure, and the method can thus be used for high speed production of cartons of uncoated board.

5 Claims, 2 Drawing Figures

FORMING CARTONS

BACKGROUND OF THE INVENTION

1. Field of the Invention

This invention relates to methods of forming cartons, in which a carton blank of uncoated board is erected and selected parts thereof are adhered to cooperating parts of the blank to form a carton.

2. Description of the Prior Art

It is known to erect a carton by means of a punch which is forced through the plane of the blank and which cooperates with a die arrangement having pressure members to erect the carton and to press selected parts of the blank against cooperating parts of the blank to seal them together. Examples of this method, using thermoplastic adhesives or thermoplastic coatings on the blanks, are described in our British Patent Specifications Nos. 928135 and 1187258. The latter also describes how the selected and cooperating parts of the carton blank can be pre-heated by hot air jets to soften and render tacky a thermoplastic coating thereon, to assist the sealing.

For erecting cartons from blanks of uncoated board, it has been normal practice to apply by jet or brush to the appropriate parts of the carton blank a water-based adhesive, e.g. of aqueous-dispersed polyvinyl acetate. The blank, unheated, is thereafter erected to carton form in a punch and cooperating die arrangement, whereafter it is passed through a long pressure section by which pressure is maintained on the selected and cooperating parts of the erected carton for a time, typically one second in duration, sufficient for the adhesive to dry. As an alternative to the use of a pressure section following the punch and die arrangement, the erected carton may be held for the necessary drying period in the punch and die arrangement itself. No specially provided pressure section is then required, but the throughput of the punch and die arrangement is correspondingly limited.

Another type of adhesive which has been used in the erection of cartons from blanks of uncoated board is a hot melt adhesive which is applied in molten form to the appropriate parts of the carton blank before the blank enters the punch and die arrangement. Such an adhesive is substantially instantaneous in its action, so that no holding or dwell period is required to allow it to set. However, it is expensive in comparison with water-based adhesives and moreover is unsatisfactory for use with some types of board, e.g. grease resistant board, which are uncoated but include additives to the furnish from which they are made.

The known methods have either been wasteful of adhesive and subject to severe throughput limitations (in the case of water-based adhesive), or, in the case of hot melt adhesive, have employed a high cost adhesive and have been unsatisfactory for some types of board.

It has been proposed in European Patent Application No. 79200702.3 (Publication No. 0017678 A1) to form a heat-resistant carton by coating at least one of the carton surfaces with a heat-activated thermosetting adhesive, then spraying a water-based adhesive emulsion (e.g. an aqueous emulsion of polyvinyl acetate) on the coated surfaces, heating at least the water-based adhesive coated surface (e.g. by a stream of heated air) to at least partially dry the water-based adhesive, placing the mating carton surfaces in contact with each other, and applying pressure for a time sufficient to seal the contacting surfaces together. It is said that the combination of thermosetting adhesive and water-based adhesive enables the mating surfaces of the carton to be rapidly sealed by automatic carton sealing apparatus.

SUMMARY OF THE INVENTION

It is an object of the present invention to provide a particularly economical high speed method of production of cartons from uncoated board.

According to the present invention, a method of forming a carton is provided, in which a carton blank is folded to erect the carton by means of a punch which cooperates with a die arrangement having pressure members to erect the carton and to press selected parts of the blank against cooperating parts of the blank to seal them together, wherein the blank is of uncoated board and a water-based adhesive is first applied as an atomised spray to the selected parts of the carton blank, the sprayed adhesive is partially dried by directing hot gas on to the selected parts, and the folding of the carton blank to erect the carton is then effected by the punch and cooperating die arrangement so as to secure the selected and cooperating parts together by means of the partially dried adhesive and thereby to maintain the carton in the erected form.

The water-based adhesive may be an aqueous-dispersed polyvinylacetate.

It has been found that the combination of application of the water-based adhesive as an atomised spray and its drying by hot air enables rapid and effective adhesion of the selected and cooperating parts of the carton to be made under the pressure exerted between the punch and die arrangement, even though the board employed is uncoated. Adhesion can be effected in an exceptionally short time so that only the very brief pressure generated by the punch and cooperating die arrangement when operated at normal speed is required. In consequence, no pressure section is required to act on the carton after it has been erected by the punch and cooperating die arrangement, nor is there any need to hold the carton in the punch and die arrangement while the adhesive dries. The rates of production of cartons can therefore be much increased in relation to previous methods of using water-based adhesive with uncoated board. At the same time, because the water-based adhesive (e.g. polyvinylacetate) is relatively inexpensive, and the amount sprayed on to the selected parts can be accurately controlled, the adhesive material costs can be much reduced.

Preferably the adhesive is sprayed on to the selected parts by a spray gun or guns under the control of a sensor arranged to detect the arrival of the carton blank or carton at the appropriate position for spraying. The outlet from the or each spray gun may be a nozzle controlled by a needle valve which is operated by a solenoid on receipt of a signal from the sensor. Preferably the needle valve and nozzle cooperate to cause a swirling motion of the atomised spray of adhesive.

The carton blank may be fed from the spraying position to a position in which the hot gas is directed on to the selected parts.

Alternatively, the hot gas may be directed on to the selected parts while the carton blank remains in the spraying position. In that case, the hot gas may be directed on to the selected parts through a spray gun or guns which is or are also used to spray the adhesive thereon.

Preferably each of a plurality of lateral projections on the punch cooperates with a respective spring-loaded pressure member to press the selected parts of the carton blank against the cooperating parts thereof.

DETAILED DESCRIPTION OF THE INVENTION

Figures 1, 2:
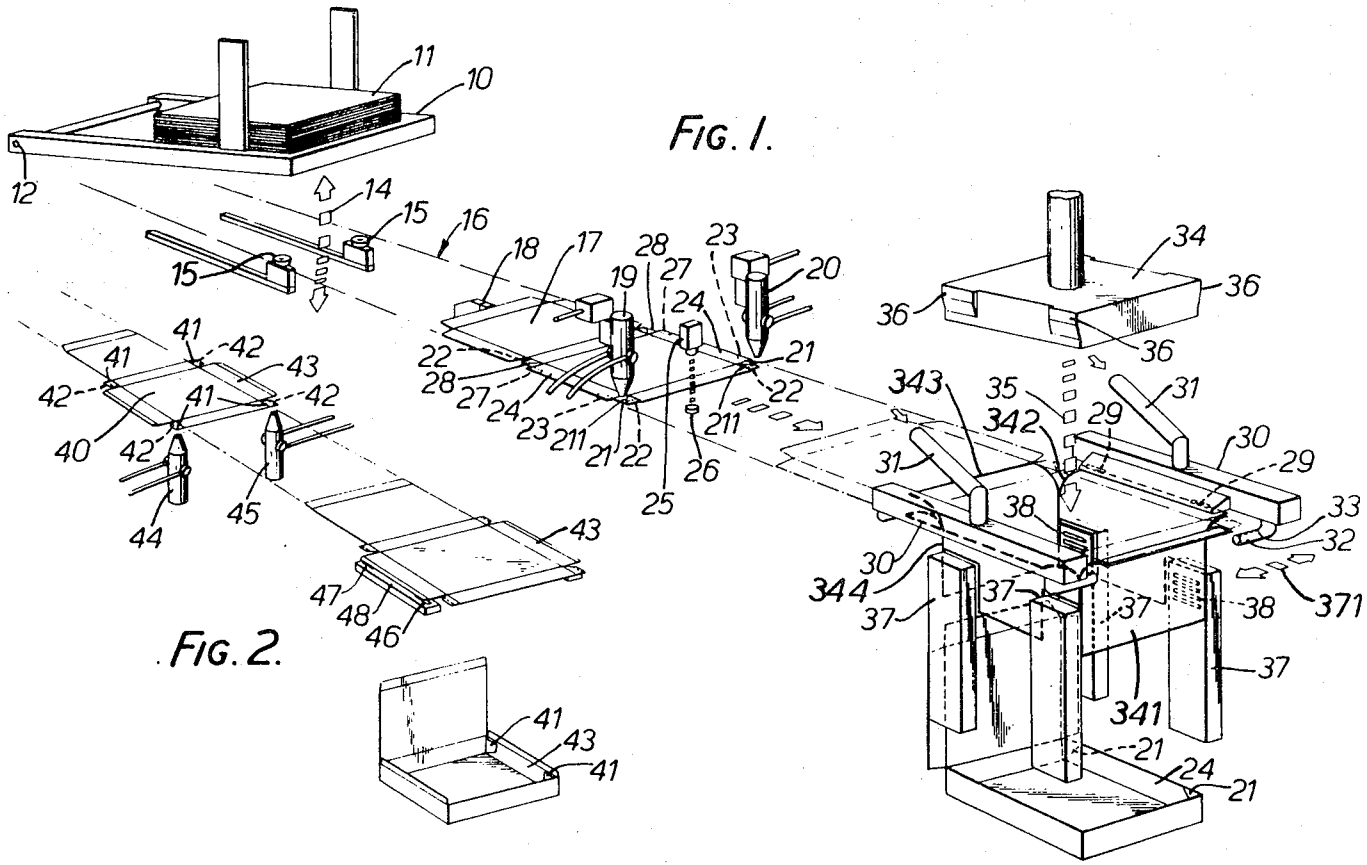
FIG. 1 is a diagrammatic perspective view of an apparatus for erecting a carton from a one-piece blank of uncoated board.
FIG. 2 illustrates a modification for use with another type of one-piece blank.

As shown in FIG. 1, the apparatus comprises a magazine 10 for holding a stack 11 of one-piece carton blanks. The magazine is pivotally mounted at 12 on a horizontal axis for movement as indicated by the arrow 14. A pair of suction pads 15 are provided in known manner to remove the bottom blank from the stack 11 each time the magazine reaches its lower or horizontal position.

The suction pads 15 lie in a horizontal track generally indicated at 16 along which the carton blanks 17 are moved by conventional means indicated here as comprising a feed dog 18 which is movable longitudinally of the track 16. Blank 17 is illustrated in full lines approaching the position for application of adhesive by means of a pair of solenoid-controlled spray guns 19,20. The blank 17 is of the type having front and rear bellows-fold corner panels 21,28 which, on erection of the carton, are folded inside the carton and are then secured by adhesive against the inside of one side wall 24 of the carton as can be seen at the right hand lower end of FIG. 1. For this purpose, the bellows corner panels 21,28 are cut away so as to be rectangular instead of square, the 45° diagonal fold 211 of each corner panel 21,28 thereby being caused to intersect the longer side of the corner panel so that, when erected, a portion 22 of each corner panel 21,28, which lies on the underside of the blank 17 in the unfolded condition, can be brought into contact with a respective portion 23,27 of the upper side of the blank which lies on the inside of the upfolded side wall 24 of the carton. The spray guns 19,20 are accordingly positioned to apply adhesive to the portions 23,27 of the blank.

A sensor 26, which may be a photocell cooperating with a light source 25, is arranged to detect the arrival of the leading edge of the blank 17 at the position for application of the adhesive and to generate a signal for actuation of the solenoid-controlled spray guns 19,20 so as to deliver an atomised spray of an aqueous-dispersed polyvinylacetate adhesive on to the portions 23 of the blank. Each of the spray guns 19,20 has a nozzle controlled by a needle valve (not shown) operated by a solenoid on receipt of a signal from the sensor 26. A time delay mechanism is incorporated so as to cause the spray guns 19,20 to deliver a second spray on to the portions 27 of the blank which cooperate with the rear bellows corners 28. The needle valves of the spray guns 19,20 can be accurately controlled so as to deliver a metered quantity of the adhesive on to the precise portions 23,27 required without waste of adhesive. It has been found advantageous to arrange each needle valve and nozzle so as to cooperate to cause a swirling motion of the atomised spray of adhesive. By applying the adhesive as an atomised spray, a minimum amount of the aqueous carrier is applied to the blank 17 and evaporation of the aqueous carrier is accordingly facilitated.

From the illustrated position of the blank 17, it is moved onwards by the feed dog 18 to the position illustrated in chain lines where hot air is applied through elongated nozzles 29 to the selected areas 23,27 on which the adhesive has been applied. The hot air is delivered to the nozzles 29 through manifolds 30 and feedpipes 31. The manifolds 30 also carry short pipes 32 at each end formed with nozzles 33 through which hot air is directed at the portions 22 on the undersides of the bellows corners so as to pre-heat them ready for adhesion to the selected areas 23,27. The application of hot air to the areas 23,27 causes rapid drying of the polyvinylacetate adhesive, rendering it tacky and ready for substantially instant adhesion to the areas 22.

A vertically reciprocable punch 34 is arranged to move in the direction of arrow 35 so as to be forced through the plane of the blank 17 and, in cooperation with a square die arrangement comprising radiused carton forming plates 341, 342, 343, 344, supporting the blank in known manner, to erect the carton into the form shown at the bottom right hand portion of FIG. 1. The punch 34 is provided with chamfered projections 36 at each corner. Each projection 36 cooperates with a respective spring loaded pressure member 37 movable as indicated by arrow 371 and forming part of the die arrangement and carrying a set of small horizontal rollers 38 so as to apply a brief but strong pressure to the selected areas 23,27 and the cooperating areas 22 of the bellows corners.

The step of forcing the punch 34 through the plane of the blank in cooperation with the die arrangement having the pressure members 37 thus causes the carton blank to be folded into the erect state and also effects the necessary brief but strong pressure of the selected parts of the blank against the cooperating parts to secure them together by means of the partially dried and tacky polyvinylacetate adhesive, which cures substantially instantaneously and thereby maintains the carton in the erected form seen at the bottom right hand corner of FIG. 1.

The erected carton can then be carried forward along another conveyor (not shown), e.g. to filling and closing stations.

FIG. 2 illustrates diagrammatically an adaptation of the apparatus of FIG. 1 to use with a different type of one-piece carton blank 40, also of uncoated board, in which flaps 41 have adhesive applied to their lower surfaces at 42 so as to enable them to be adhered to the inside of the upfolded side walls 43 as shown at the bottom right hand corner of FIG. 2. For this purpose, the solenoid controlled spray guns 19,20 of FIG. 1 are replaced by a pair of similar spray guns 44,45 disposed beneath the path of the blank 40 and the hot air nozzles 29 are replaced by similar nozzles 46,47 in manifolds 48 again disposed beneath the path of the blank 40 so as to be able to dry the adhesive applied on areas 42. In other respects, the apparatus of FIG. 2 is similar to that of FIG. 1 and operates in the same manner.

The methods described above have been found effective in enabling high-speed forming of cartons from blanks of uncoated board. The term "uncoated board" naturally does not exclude board materials which include additives which are added to the furnish from which the board is made, such as the known grease-resistant board materials, but it does exclude board materials with coatings applied after the board has been produced, such as the commonly used but expensive thermoplastics coated boards.

I claim:

1. A method of forming a carton, in which a carton blank is folded to erect the carton by means of a punch which is forced through the plane of the blank and which cooperates with a die arrangement having pressure members to erect the carton and to press selected parts of the blank against cooperating parts of the blank to seal them together, wherein the blank is of uncoated board and a water-based adhesive is first applied as an atomized spray to the selected parts of the carton blank by a spray gun or guns under the control of a sensor arranged to detect the arrival of the carton blank at the appropriate position for spraying, the outlet from the or each spray gun being a nozzle controlled by a needle valve which is operated by a solenoid on receipt of a signal from the sensor, and the needle valve and nozzle cooperating to cause a swirling motion of the atomized spray of adhesive, the sprayed adhesive is partially dried by directing hot gas on to the selected parts, and the folding of the carton blank to erect the carton is then effected by the punch and cooperating die arrangement so as to secure the selected and cooperating parts together by means of the partially dried adhesive and thereby to maintain the carton in the erected form.

2. A method according to claim 1 wherein the water-based adhesive is an aqueous-dispersed polyvinylacetate.

3. A method of forming a carton, in which a carton blank is folded to erect the carton by means of a punch which is forced through the plane of the blank and which cooperates with a die arrangement having pressure members to erect the carton and to press selected parts of the blank against cooperating parts of the blank to seal them together, wherein the blank is of uncoated board and a water-based adhesive is first applied as an atomized spray to the selected parts of the carton blank, the sprayed adhesive is partially dried by directing hot gas on to the selected parts while the carton blank remains in the spraying position, and the folding of the carton blank to erect the carton is then effected by the punch and cooperating die arrangement so as to secure the selected and cooperating parts together by means of the partially dried adhesive and thereby to maintain the carton in the erected form.

4. A method according to claim 3 wherein the hot gas is directed on to the selected parts through a spray gun or guns which is or are also used to spray the adhesive thereon.

5. A method according to claim 3 wherein each of a plurality of lateral projections on the punch cooperates with a respective spring-loaded pressure member to press the selected parts of the carton blank against the cooperating parts thereof.

* * * * *